US008358324B2

(12) United States Patent
Kokuta

(10) Patent No.: US 8,358,324 B2
(45) Date of Patent: Jan. 22, 2013

(54) THERMAL PRINTER

(75) Inventor: Hiroshi Kokuta, Tokyo (JP)

(73) Assignees: Kabushiki Kaisha Sato (JP); Kabushiki Kaisha Sato Chishiki Zaisan Kenkyusyo (JP)

( * ) Notice: Subject to any disclaimer, the term of this patent is extended or adjusted under 35 U.S.C. 154(b) by 213 days.

(21) Appl. No.: 12/865,944

(22) PCT Filed: Oct. 6, 2008

(86) PCT No.: PCT/JP2008/068172

§ 371 (c)(1),
(2), (4) Date: Aug. 3, 2010

(87) PCT Pub. No.: WO2009/098801

PCT Pub. Date: Aug. 13, 2009

(65) Prior Publication Data

US 2010/0309275 A1 Dec. 9, 2010

(30) Foreign Application Priority Data

Feb. 8, 2008 (JP) ..... 2008-028684

(51) Int. Cl.
*B41J 25/34* (2006.01)

(52) U.S. Cl. ..... 347/197

(58) Field of Classification Search ..... 347/197, 347/222; 400/120.16

See application file for complete search history.

(56) References Cited

U.S. PATENT DOCUMENTS

| | | | | |
|---|---|---|---|---|
| 5,694,159 | A | 12/1997 | Kajiya et al. | 347/197 |
| 2007/0091162 | A1 | 4/2007 | Takabatake | 347/220 |

FOREIGN PATENT DOCUMENTS

| | | | |
|---|---|---|---|
| JP | 9-115010 | A | 5/1997 |
| JP | 11-216889 | | 8/1999 |
| JP | 2000-43365 | A | 2/2000 |
| JP | 2004-22370 | A | 8/2004 |
| JP | 2007-54968 | A | 3/2007 |
| WO | WO 03/080347 | | 10/2003 |

OTHER PUBLICATIONS

Machine-generated translation of JP 2004-223730, published on Aug. 2004.*

International Search Report dated Nov. 11, 2008, issued in corresponding international application No. PCT/JP2008/068172.

Supplementary Search Report dated Apr. 10, 2012 issued in corresponding European Patent Application No. 08872177.4 (5 pages).

* cited by examiner

*Primary Examiner* — Huan Tran
(74) *Attorney, Agent, or Firm* — Ostrolenk Faber LLP

(57) ABSTRACT

A thermal printer in which a thermal head can be attached easily to a print unit without requiring a tool such as a screw driver.

The thermal printer has a printing unit (40) having a left ribbon frame (43) and a right ribbon frame (42) facing each other. A head housing (60) is attached between the frames (42, 43) while supporting a thermal head (12). A supporting-recess in the surface of the left ribbon frame (43) faces the right ribbon frame (42) and supporting the left side face (64) of the head housing (60). A frame cover (70) is fitted on and removed from a fitting portion provided on the outer surface of the right ribbon frame which is at the back side of the surface facing the left ribbon frame (43) and the cover supporting a right side face (62) of the head housing (60) through a through-hole (50*a*) formed on the right ribbon frame (42).

8 Claims, 9 Drawing Sheets

THERMAL PRINTER

CROSS REFERENCE TO RELATED APPLICATION

The present application is a 35 U.S.C. §§371 national phase conversion of PCT/JP2008/068172 filed Oct. 6, 2008, which claims priority of Japanese Application No. 2008-028684, filed Feb. 8, 2008, the disclosure of which is incorporated by reference herein. The International Application was published in the Japanese Language.

TECHNICAL FIELD

The present invention relates to a thermal printer which performs printing by holding and conveying a printing medium between a platen roller and a thermal head. More particularly, the present invention relates to a thermal printer which performs printing using a thermal head attached between a pair of frames facing each other in a width direction of the printing medium.

BACKGROUND ART

In general, a thermal printer which performs printing using a thermal head prints predetermined print data onto a printing medium by holding and conveying a printing medium, such as a continuous label or a continuous tag, between a platen roller and a thermal head. The thermal head is supported by a printing unit such that a heat generating element is opposing the platen roller.

In the past, the attachment of the thermal head to the printing unit was performed by directly attaching the thermal head with a screw, or by attaching it using a so called spacer, which is a joining member, attached to the thermal head by a screw. (See, for example, Japanese Unexamined Patent Application, First Publication H11-216889 for reference).

However, in conventional technology, a tool, such as a screw driver, was necessary when attaching the thermal head to the printing unit, and there was a problem that the attaching process of the thermal head becoming complicated.

SUMMARY OF INVENTION

Technical Problem

The present invention has been made in view of the aforementioned problem. The object of the present invention is to provide a thermal printer which can easily attach the thermal head to the printing unit without requiring a tool such as a screw driver.

Solution to Problem

In order to solve the aforementioned problem, the thermal printer of the present invention proposes the following arrangements.

An aspect of the present invention includes a thermal printer which performs printing by holding and conveying a printing medium between a platen roller and a thermal head. The printer comprises: a printing unit provided with a first frame and a second frame facing each other in a width direction of the printing medium. A head housing supports the thermal head and is attached between the first frame and the second frame. A supporting unit is provided on an opposing surface on the first frame facing the second frame supporting a first side face of the head housing. A frame cover is fitted on and removed from a fitting portion provided on the outer surface of the second frame, which is at the back side of the surface facing the first frame and supporting a second side face of the head housing through a through-hole formed on the second frame.

Another aspect of the present invention relates to the above thermal printer support-recess for the head housing to be supported is formed on the second side face of the head housing, and wherein a supporting-protrusion fitted into the supported-recess formed on the second side face of the head housing through the through-hole formed on the second frame is formed on the frame cover.

Another aspect of the present invention relates to the above thermal printer wherein the supporting unit supports the first side face of the head housing at a more upstream side of the conveyance direction of the printing medium than the thermal head as a rotational axis enabling to move rotationally, and wherein, the supported-recess formed on the second side face of the head housing is in a round shape, with the rotational axis supported by the supporting unit consistent with the axis of the supported-recess.

In yet another aspect of the present invention, the thermal printer performs printing by transferring ink from an ink ribbon onto the printing medium, and between the first frame and the second frame, a ribbon supply shaft supplying the ribbon and a ribbon take-up shaft taking-up the ribbon are rotatably bridged over.

In another aspect of the present invention, a driving force transferring mechanism on the first frame transfers the driving force to the ribbon take-up shaft, and through-holes are formed on the frame cover respectively at the places corresponding to the ribbon take-up shaft and the ribbon supply shaft.

In yet another aspect of the present invention, the thermal printer is provided with a head pressure regulating unit regulating the head pressure of the thermal head by the rotational movement of a regulating shaft bridged over in a direction perpendicular to the first frame and the second frame, and a through-hole is formed on the frame cover at a place corresponding to the regulating shaft.

Advantageous Effects of Invention

The thermal printer of the present invention comprises: a printing unit provided with a first frame and a second frame facing each other in a width direction of the printing medium; a head housing supporting the thermal head and attached between the first frame and the second frame; a supporting unit provided on an opposing surface on the first frame facing the second frame supporting a first side face of the head housing; and a frame cover fitted on and removed from a fitting portion provided on the outer surface of the second frame which is at the back side of the surface facing the first frame and supporting a second side face of the head housing through a through-hole formed on the second frame.

In this way, the thermal printer of the present invention enables easy attaching and detaching of the head housing supporting the thermal head, by only fitting on and removing the frame cover from the outer surface of the second frame. In addition, the thermal printer of the present invention enables easily attaching the thermal head to the printing unit without requiring a tool such as a screw driver.

Furthermore, the thermal printer of the present invention is configured such that a supported-recess for the head housing to be supported is formed on the second side face of the head housing, and a supporting-protrusion on the frame cover is fitted into the supported-recess formed on the second side face of the head housing through the through-hole formed on the second frame. In this way, the thermal printer of the present invention achieves an effect of accurately positioning the head housing supporting the thermal head by removably fitting the frame cover to the outer surface of the second frame.

Furthermore, the thermal printer of the present invention is configured such that the supporting unit supports the first side face of the head housing upstream in the conveyance direction of the printing medium of the thermal head as a rotational axis enabling to move rotationally. The supported-recess formed on the second side face of the head housing is in a round shape, with the rotational axis supported by the supporting unit consistent with the axis of the supported-recess. In this way, the thermal printer of the present invention can rotatably support the thermal head by only removably fitting the frame cover to the outer surface of the second frame, thereby simplifying the mechanism pressing the thermal head to the platen roller.

Furthermore, the thermal printer of the present invention is configured such that a ribbon take-up shaft and a ribbon supply shaft are rotatably bridged over between the first frame and the second frame. In this way, the thermal printer of the present invention can use the ribbon frames, where the ribbon take-up shaft and the ribbon supply shaft are bridged over, also as a structure supporting the thermal head, thereby achieving the effects of cost reduction by reducing the number of parts, and downsizing the thermal printer.

Still further, the thermal printer of the present invention is configured such that on the first frame, a driving force transferring mechanism transferring the driving force to the ribbon take-up shaft is provided, and the through-holes are formed respectively at the places on the frame cover corresponding to the ribbon take-up shaft and the ribbon supply shaft. Even in a state with the frame cover fitted to the outer surface of the second frame, it is possible to achieve the effect of easily regulating the ribbon take-up shaft and the ribbon supply shaft through the through-holes formed on the frame cover from the second frame side where the driving force transferring mechanism is not provided.

Furthermore, the thermal printer of the present invention is configured with a head pressure regulating unit regulating the head pressure of the thermal head by the rotational movement of a regulating shaft bridged over in a direction perpendicular to the first frame and the second frame, and a through-hole is formed on the frame cover at a place corresponding to the regulating shaft. In this way, even in a state with the frame cover fitted to the outer surface of the second frame, it is possible to achieve the effect of easily regulating the head pressure from the second frame side by operating the regulating shaft through the through-hole formed on the frame cover.

BRIEF DESCRIPTION OF DRAWINGS

FIG. 4(*b*) is a front perspective view diagram showing the configuration of the head housing shown in FIG. 3 from the front side.

FIG. 4(*c*) is a rear perspective view diagram showing the configuration of the head housing shown in FIG. 3 from the rear side.

DESCRIPTION OF EMBODIMENTS

Hereinafter, an embodiment of the present invention is described in detail based on the drawings.

Figure 1:
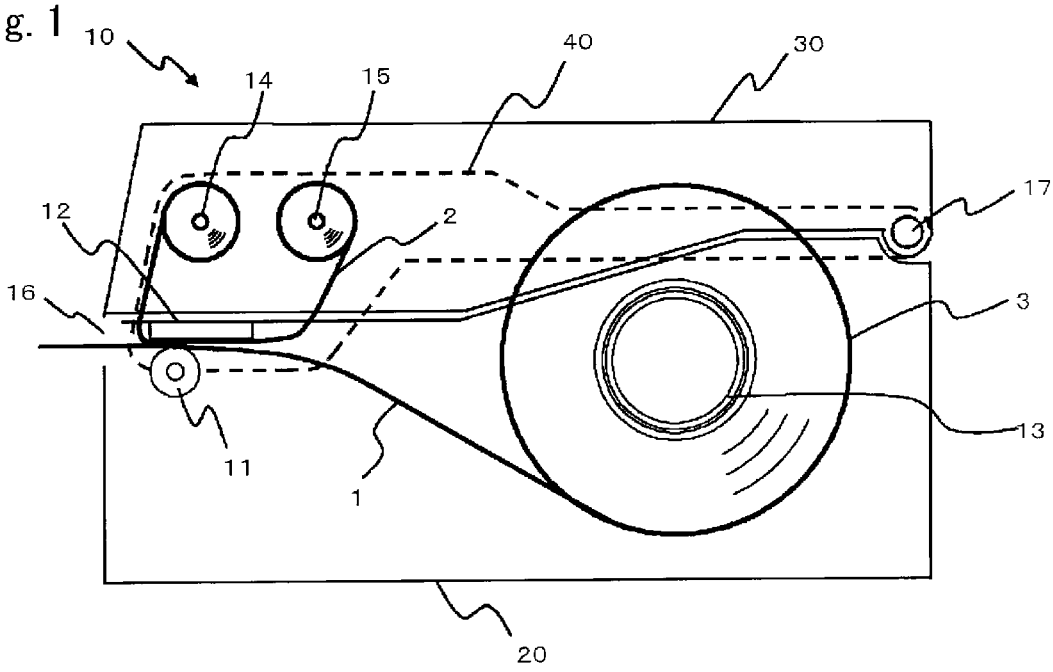
FIG. 1 is a schematic side view diagram showing the configuration of the thermal printer in the embodiment of the present invention.

With reference to FIG. 1, the thermal printer 10 of the present embodiment is provided with a platen roller 11, and a thermal head 12 arranged such that the surface (hereinafter called as printing surface) on which a plurality of heat generating element is formed in the widths direction is facing the platen roller 11, together defining a printing unit. The thermal printer 10 is configured to layer a printing medium 1 such as a continuous label strip with a plurality of labels temporarily attached on a strip form backing sheet, and an ink ribbon 2, then hold and convey them between the platen roller 11 and the thermal head 12. Then the thermal printer 10 performs printing by transferring the ink to the printing medium 1 from an ink ribbon 2 by selectively generating heat of the heat generating element in the thermal head 12.

The printing medium 1, is in a state wound in a roll to define a tubular body such as a paper tube, that is, a roll of paper 3, is rotatably supported at the supply unit 13. The printing medium 1 is supplied between the platen roller 11 and the thermal head 12 from the supply unit 13. In addition, the ink ribbon 2 is laid between a ribbon take-up shaft 14 which is rotationally driven interlocking with the platen roller 11, and a ribbon supply shaft 15. The ink ribbon 2, in a state wound in a roll supported at the ribbon supply shaft 15, is supplied between the platen roller 11 and the thermal head 12 together with the printing medium 1. After transferring the ink, the ink ribbon 2 is taken-up by the ribbon take-up shaft 14.

Furthermore, the thermal printer 10 is provided with a main unit 20, of which an upper portion is opened, and having a platen roller 11 and a supply unit 15, an upper cover unit 30 covering the upper portion of the main unit 20, and a printing unit 40, arranged between the main unit 20 and the upper cover unit 30, having a thermal head 12, a ribbon take-up shaft 14, and a ribbon supply unit 15. The upper cover unit 30 and the printing unit 40 are supported to rotate open and closed by the supporting shaft 17 provided at the back side of the main unit 20. In addition, the upper cover unit 30 and the printing unit 40 are configured such that they may be opened from the front side where the outlet 16 discharges the printed print medium.

Figure 2:
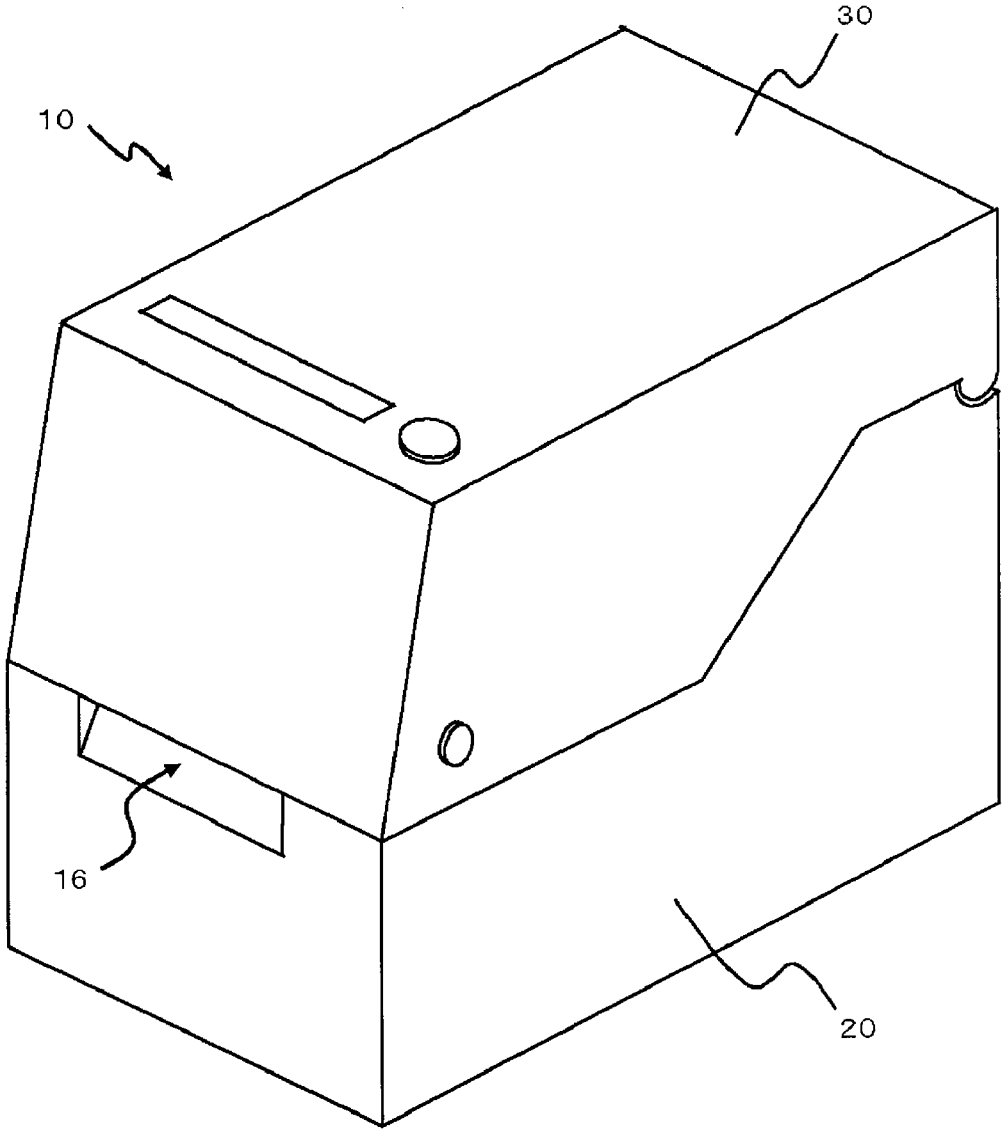
FIG. 2 is an external perspective view diagram showing the closed state of the thermal printer in the embodiment of the present invention.

In FIG. 2, the thermal printer 10 in a closed state with the upper cover unit 30 closed is shown. In this closed state, the printing unit 40 is positioned between the main unit 20 and the upper cover unit 30. As shown in FIG. 1, in this closed state, the printing unit 40 is positioned so that the thermal head 12, which is provided at the printing unit 40, is pushed against the platen roller 11, which is provided at the main body 20. Furthermore, the printing unit 40 is configured such that can be fitted into the upper cover unit 30. In the closed state shown in FIG. 2, the printing unit 40 is in a fitted state fitted into the upper cover unit 30.

Figure 3:
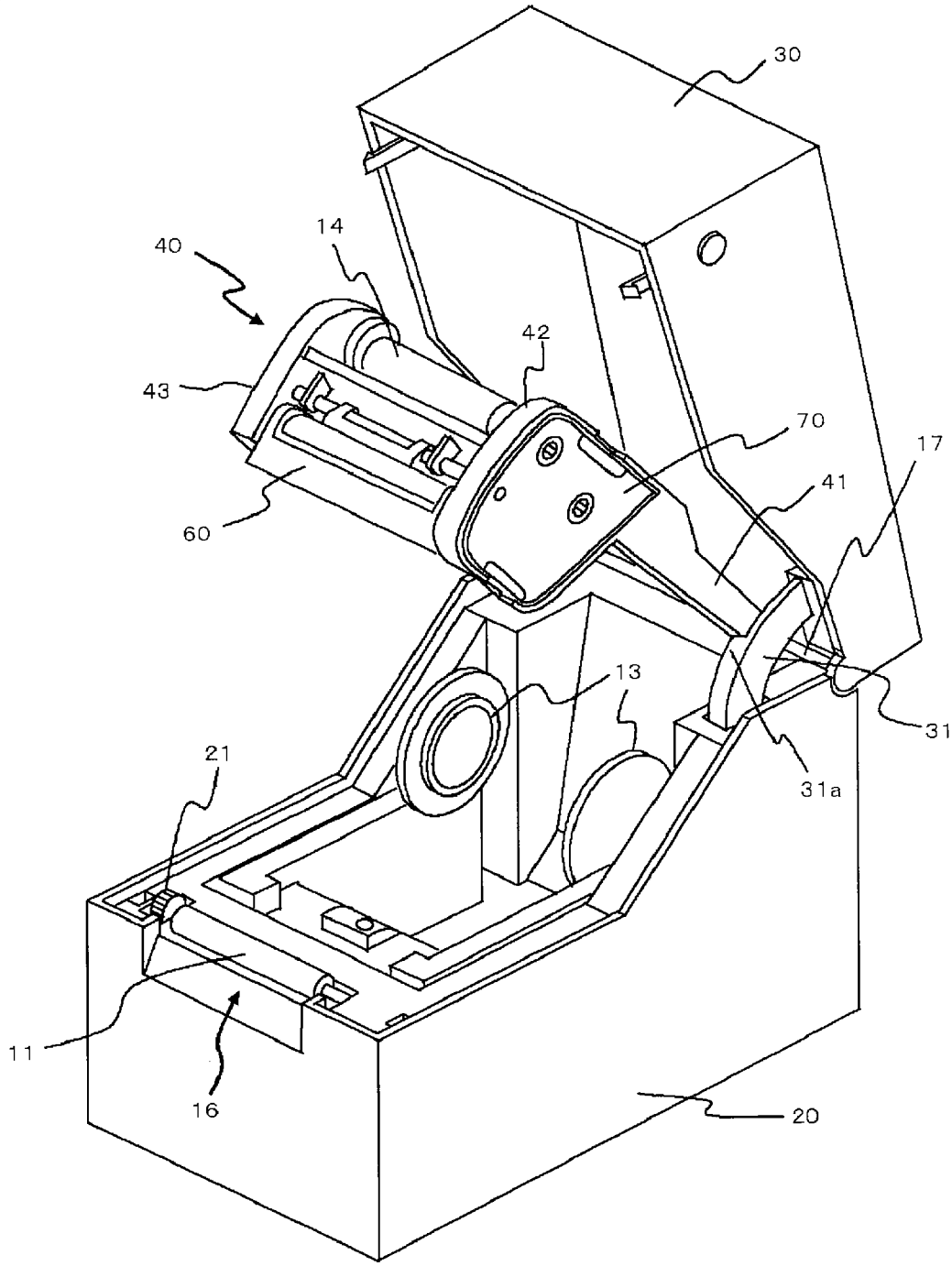
FIG. 3 is an external perspective view diagram showing the opened state of the thermal printer in the embodiment of the present invention.

In FIG. 3, the thermal printer 10 is shown in an opened state with the upper cover unit 30 opened. In this opened state, it is possible to respectively rotate the upper cover unit 30 and the printing unit 40 independently. The upper cover unit 30 is configured such that it is maintained at the opened state shown in FIG. 3 by the opening and closing stopper 31, even if an operator's hands are released from it. In addition, an arm portion 41 of the printing unit 40 engages the protruded portion 31*a* which in turn protrudes inside the opening and closing stopper 31, thereby enabling holding the upper cover unit 30 independently from the printing unit 40 in a state as shown in FIG. 3. Furthermore, at the upper cover unit 30, a not shown abutting member maintains the printing unit 40 in a fitted state by resiliently abutting to the printing unit 40. When opening the upper cover unit 30 from the closed state shown in FIG. 2, the printing unit 40, in a fitted state, rotates together with the upper cover unit 30, to be in the opened state shown in FIG. 3 by pulling the printing unit 40 out from the upper cover unit 30.

Figure 4:
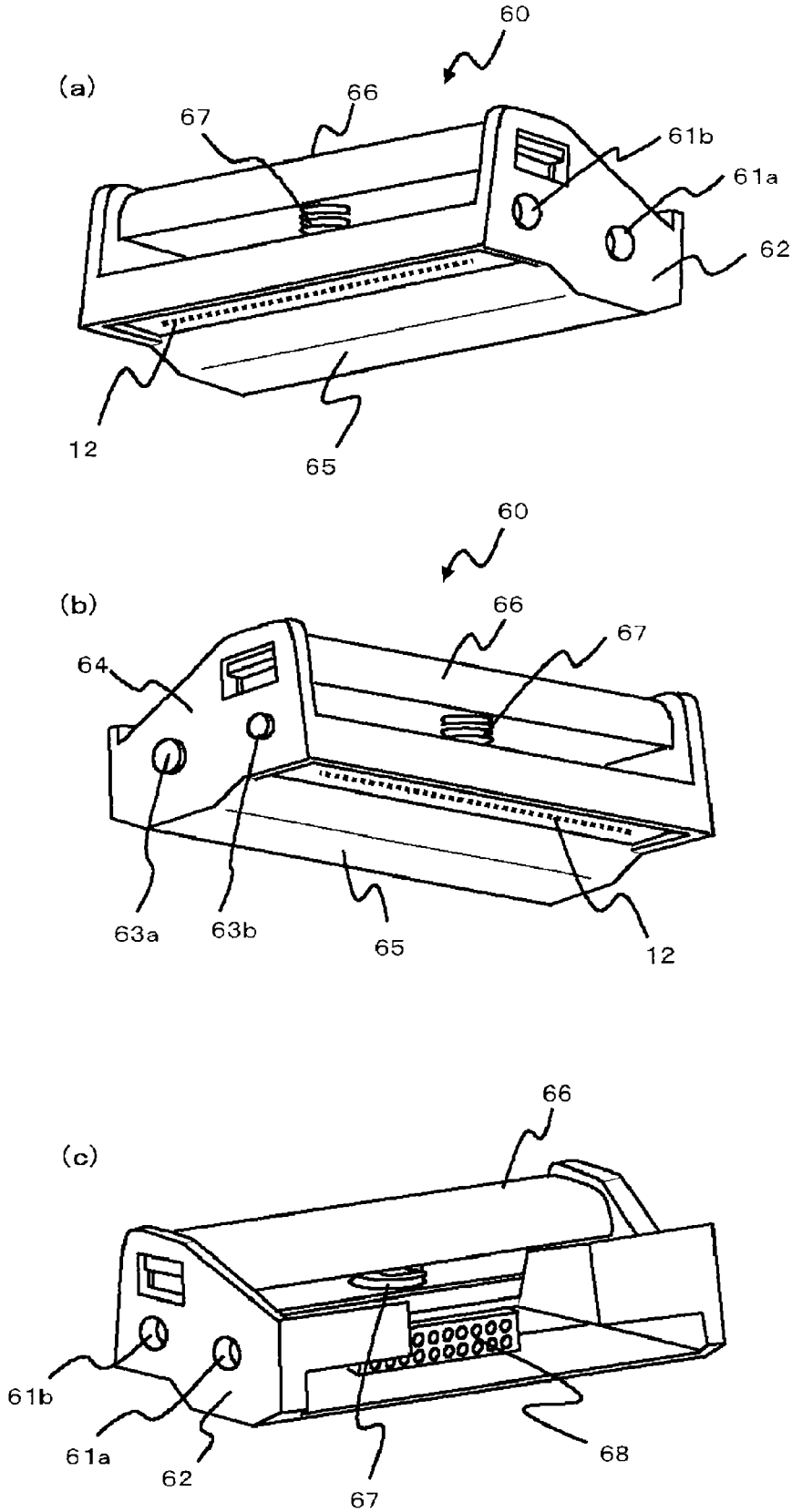
FIG. 4(*a*) is a front perspective view diagram showing the configuration of the head housing shown in FIG. 3 from the front side.

The thermal head 12 is configured such that it is attached to the printing unit 40 supported by the head housing 60. Referring to FIG. 4, the head housing 60 is provided with a round shape support-recess 61*a* arranged at a more upstream side of the conveyance direction of the printing medium 1 than the thermal head 12 (the heat generating element formed), and a right side face 62 (the second side face) where a round shape support-recess 61*b*, having the diameter of the support-recess 61, and being arranged at a downstream side of this support-recess 61*a*. In addition, the head housing has a round shape support-protrusion 63*a* (a supporting unit) arranged at a more upstream side of the conveyance direction of the printing medium 1 than the thermal head 12, and a left side face 64 (the first side face) with a round shape support-protrusion 63*b* with a diameter smaller than that of the support-protrusion 63*a*, and arranged downstream of this support-protrusion 63*a*. The support-recess 61*a* of the right side face 62 and the supported-protrusion 63*a* of the left side face 64 face each other such that the axes coincide. The support-recess 61*b* of the right side face 62 and the support-protrusion 63*b* of the left side face 64 are formed face each other such that the axes coincide.

Furthermore, a lower surface 65 of the head housing 60 functions as a guide surface which leads the ink ribbon 2 between the platen roller 11 and the thermal head 12 from the ribbon supply shaft 15.

The thermal head 12 is fixed at the head housing 60. A pressing member 66 at the back side of the printing surface of the thermal head 12 abuts the after-mentioned head pressure regulating unit when attaching the head housing 60 to the printing unit 40. The pressing member is supported movably in a direction perpendicular to the printing presses the thermal head 12 fixed to the head housing 60 against the platen roller 11. FIG. 4 (*c*) shows a connector 68 of the thermal head 12.

Figure 5:
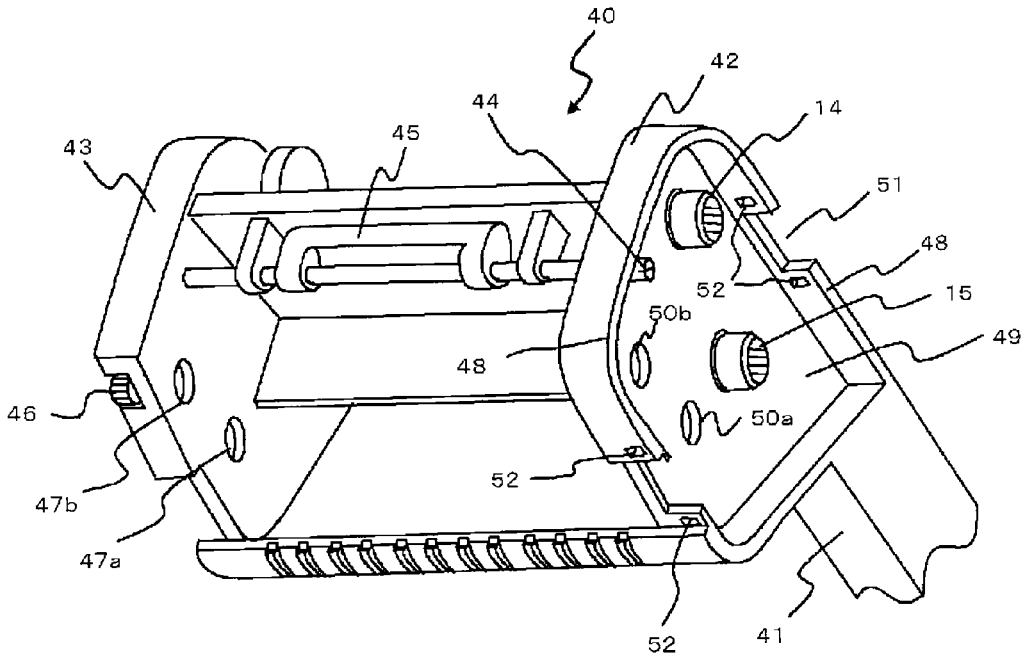
FIG. 5 is a perspective view diagram showing the configuration of the printing unit shown in FIG. 3.

Referring to FIGS. 3 and 5, the printing unit 40 is on the open end side of the arm portion 41, and the other end of portion 41 is supported by the supporting shaft 17. The arm portion 41 has a right ribbon frame 42 (the second frame) and a left ribbon frame 43 (the first frame), where the ribbon take-up shaft 14 and the ribbon supply shaft 15 are respectively bridged over in a rotatable manner. The distance between the right ribbon frame 42 and the left ribbon frame 43 is set slightly larger than the width of the head housing 60, which enables attachment of the head housing 60 between the right ribbon frame 42 and the left ribbon frame 43. In addition, on the upper pressing member 66 side of the attached head housing 60, a regulating shaft 44 is bridged over in a direction perpendicular to the right ribbon frame 42 and the left ribbon frame 43. A head pressure regulating unit is attached to this regulating shaft 44 and comprises an eccentric member 45 abutting the pressing member 66 of the head housing 60 for regulating the pressing force of the thermal head 12 to the platen roller 11 by the eccentric member 45 regulating the position of the pressing member 66 of the head housing 60.

On the left ribbon frame 43, there is a driven gear 46, which is engaged with a driving gear 21 in FIG. 3, which is rotationally driven with the platen roller 11 in the closed state shown in FIG. 2. Also located on the left ribbon frame 43, is a not shown driving force transferring mechanism, such as a gear, which transfers the rotational driving force from the driven gear 46 to the ribbon take-up shaft 14. On the surface of the left ribbon frame 43 facing the right ribbon frame 42, is a round shape supporting-recess 47*a*, where a support-protrusion 63*a* is fitted and the recess has almost the same diameter as the supported-protrusion 63*a* formed on the left side face 64 of the head housing 60, is formed. Also, on the surface of the left ribbon frame 43 facing the right ribbon frame 42, is a round shape supporting-recess 47*b*, where a support-protrusion 63*b* is loosely fitted and having a larger diameter than the support-protrusion 63*b* formed on the left side face 64 of the head housing 60.

Figure 6:
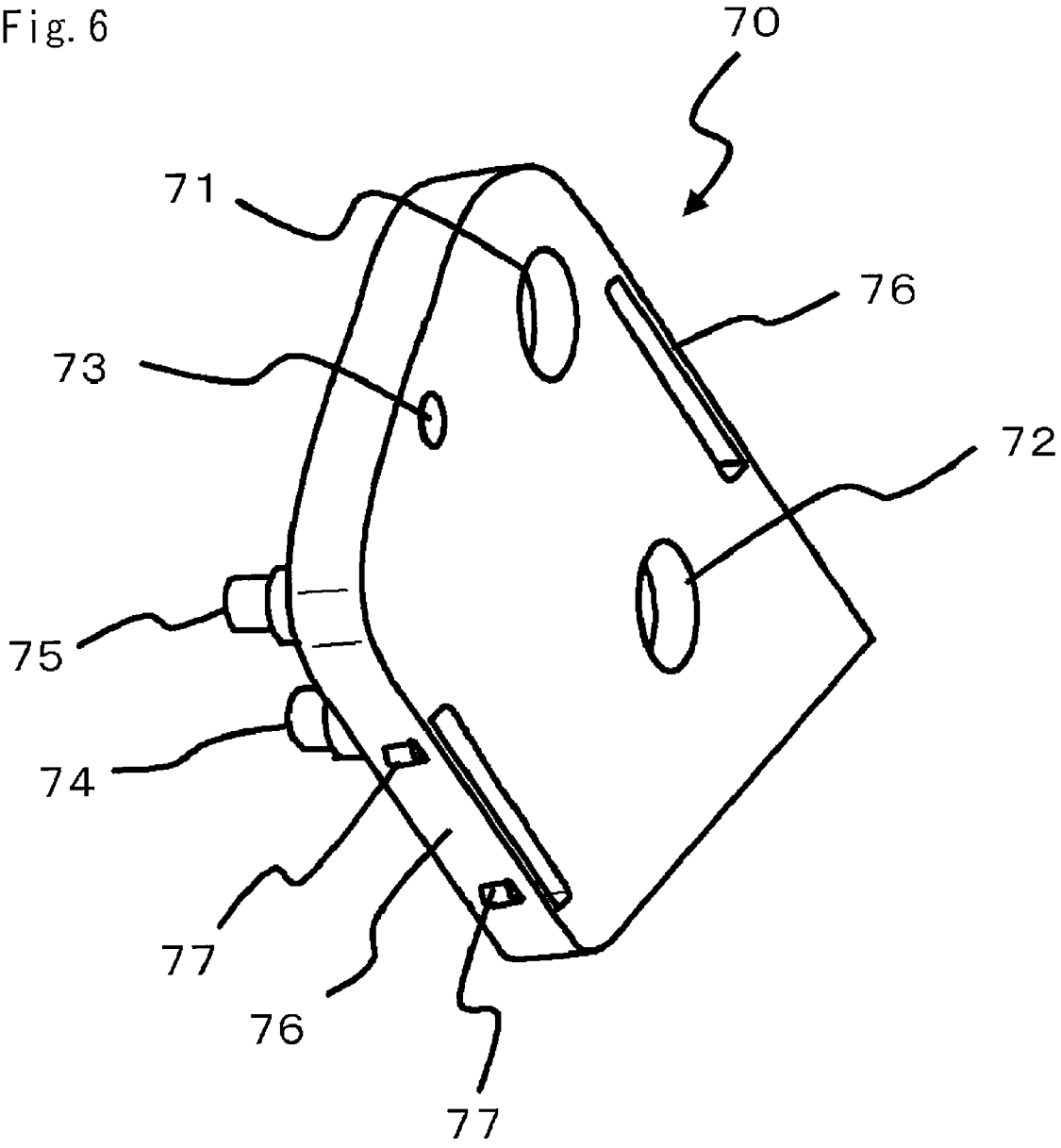
FIG. 6 is a perspective view diagram showing the configuration of the frame cover shown in FIG. 3.

On the outer surface of the right ribbon frame 42 which is at the back side of the surface facing the left ribbon frame 43, there is a frame rim 48 perpendicular to the outer surface, and formed on the outer edges. The region surrounded by the frame rim 48 functions as a fitting portion 49 in which it is possible to fit and remove a frame cover 70 shown in FIG. 6. The frame cover 70 is a plate-like member made of resin. The shapes of the fitting portion 49 and the frame cover 70 are asymmetric, so that the frame cover 70 is fitted to the fitting portion 49 in a specific orientation.

Referring to FIG. 5, the ribbon take-up shaft 14, the ribbon supply shaft 15, and the regulating shaft 44 project through the right ribbon frame 42 at the fitting portion 49. Also, the frame cover 70 has through-holes 71, 72, and 73, through which the ribbon take-up shaft 14, the ribbon supply shaft 15, and the regulating shaft 44 project beyond the fitting portion 49. When the frame cover 70 is fitted to the fitting portion 49, it is possible to operate the ribbon take-up shaft 14, the ribbon supply shaft 15, and the regulating shaft 44. Furthermore, the ribbon take-up shaft 14, the ribbon supply shaft 15, and the regulating shaft 44 may be operated by a tool such as a dedicated tool or a screw driver, through the through-holes 71, 72 and 73 formed at places corresponding to the ribbon take-up shaft 14, the ribbon supply shaft 15, and the regulating shaft 44 without those shafts projecting 44. In addition, if the driving force transferring mechanism is not in the way, the ribbon take-up shaft 14, the ribbon supply shaft 15, and the regulating shaft 44 may be configured to be operated from the left ribbon frame 43 side.

Furthermore, in the right ribbon frame 42 at the fitting portion 49, a through-hole 50*a* and a through-hole 50*b* are formed at the places corresponding respectively to the support-recess 61*a* and the support-recess 61*b* which are formed on the right side face 62 of the attached head housing 60. Also, on the frame cover 70 in FIG. 6, a round shape support-protrusion 74, having a diameter about the same as the support-recess 61*a* formed on the right side face 62 of the head housing 60, is fitted into the support-recess 61*a* through a through-hole 50*a* when fitting the frame cover 70 to the fitting portion 49, is formed. Furthermore, on the frame cover 70, there is a round shape support-protrusion 75, having a smaller diameter than that of the support-recess 61*b* formed on the right side face 62 of the head housing 60, and the protrusion 75 is loosely fitted to the support-recess 61*b* through a through-hole 50*b* when fitting the frame cover 70 to the fitted portion 49.

Furthermore, on the side face of the frame cover 70 that faces the frame rim 48 when fitted together, there are two widely spaced resin spring portions 76 which are displaced in a direction perpendicular to the frame rim 48. Engaging projections 77 are formed at the resin spring portions 76. On the frame rim 48, respective notches 51 are formed at places opposing the resin spring portions 76, such that it is possible to operate the resin spring portions 76 of the frame cover 70 when fitting. Engaging recesses 52, engaging with the engaging projections 77 when fitting, are formed near the notch 51. In addition, in this embodiment, the engaging recesses 52 are formed as the through-holes penetrating through the frame rim 48.

Next, attaching the head housing 60 to the printing unit 40 is described with reference to FIGS. 7 and 8.

Figure 7:
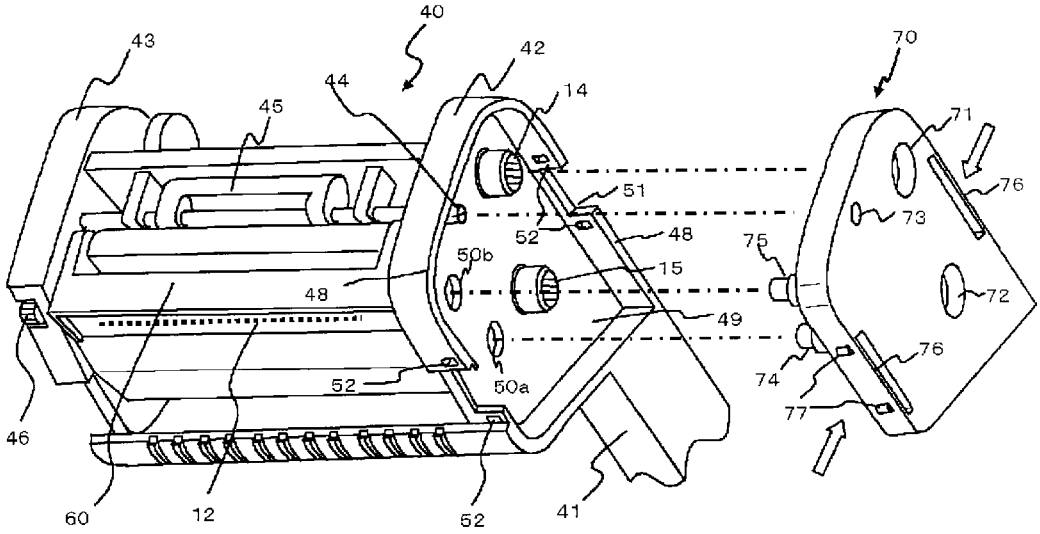
FIG. 7 is a perspective view diagram showing the attachment operation of the head housing to the printing unit shown in FIG. 3.

FIG. 7 is a perspective view diagram showing the attachment operation of the head housing 60 to the printing unit shown in FIG. 3. FIG. 8 is a perspective view diagram showing the head housing 60 in an attached state to the printing unit shown in FIG. 3. FIG. 9 is an illustration to explain the supported state of the head housing attached to the printing unit shown in FIG. 3.

In the attachment first, the support-protrusion 63*a* formed on the left side face 64 of the head housing 60 is fitted to the support-recess 47*a* formed on the surface facing the left ribbon frame 43. At the same time, the support-protrusion 63*b* formed on the left side face 64 of the head housing 60 is loosely fitted to the support-recess 47*b* formed on the opposing surface of the left ribbon frame 43. Then, as shown in FIG. 7, the head housing 60 is inserted to a predetermined position between the right ribbon frame 42 and the left ribbon frame 43. In this way, the left side face 64 of the head housing 60 will be in a state almost set and supported at a position against the opposing surface of the left ribbon frame 43. In addition, the support-recess 61*a* and the support-recess 61*b*, which are formed on the right side face 62 of the head housing 60, will be in a state respectively facing the through-hole 50*a* and the through-hole 50*b*, which are formed on the right ribbon frame 42.

Figure 8:
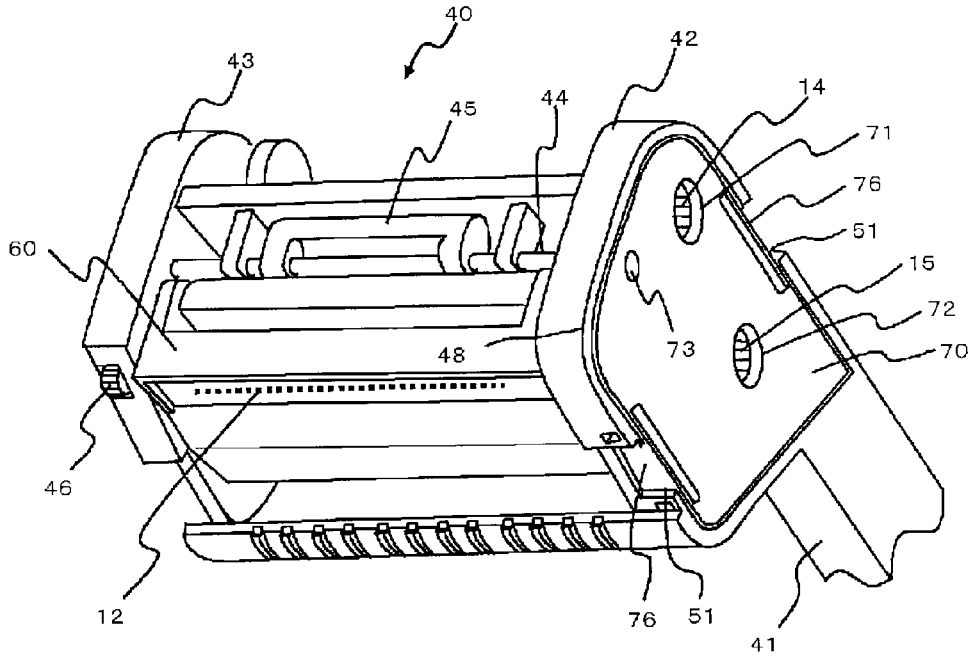
FIG. 8 is a perspective view diagram showing the head housing in an attached state to the printing unit shown in FIG. 3.
Figure 9:
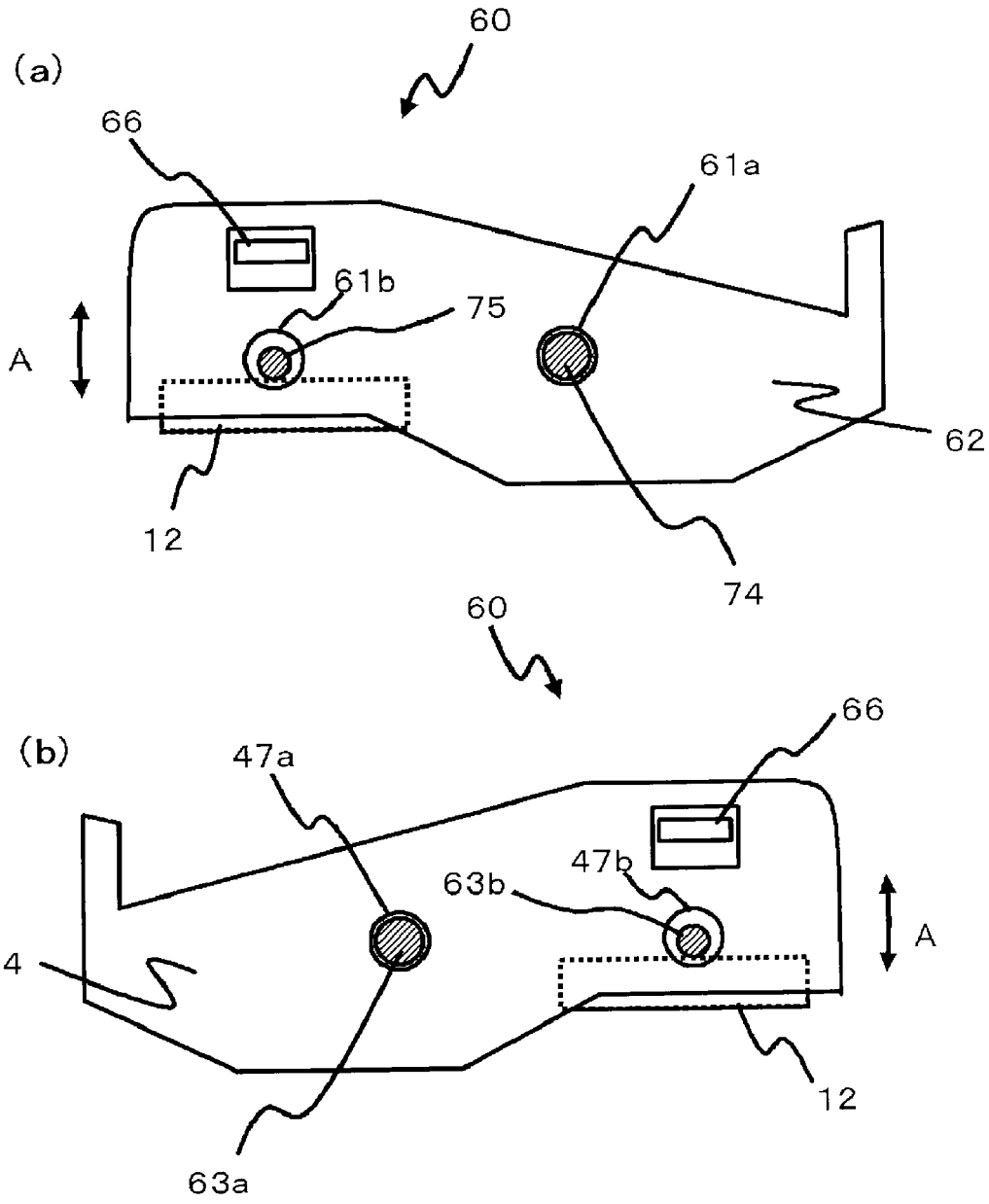
FIGS. 9*a*, 9*b* are illustrations to explain the supported state of the head housing attached to the printing unit shown in FIG. 3.

Next, as shown in FIG. 8, by pressing the resin spring portions 76 formed on the side faces as shown by the arrows in FIG. 7, the frame cover 70 is fitted to the fitting portion 49, then the resin spring portions 76 are released. In this way, the engaging projections 77 formed at the resin spring portions 76 are engaged with the engaging-recesses 52 formed on the frame rim 48, and the frame cover 70 is locked in a state fitted to the fitting portion 49.

To fit the frame cover 70 to the fitting portion 49, the support-protrusion 74 formed on the frame cover 70 is fitted to the support-recess 61*a* through the through-hole 50*a*. At the same time, the support-protrusion 75 formed on the frame cover 70 is loosely fitted to the support-recess 61*b* through the through-hole 50*b*. In this way, as shown in FIG. 9, the head housing 60 is supported with the support-recess 61*a* of the right side face 62 and the support-protrusion 63*a* of the left side face 64 both having a consistent axis, in a state respectively fitted to the support-protrusion 74 of the frame cover 70 and to the support-recess 47*a* of the left ribbon frame 43. At the same time, the support-recess 61*b* of the right side face 62 and the support-protrusion 63*b* of the left side face 64 both having a consistent axis, are respectively loosely fitted and supported by the support-protrusion 75 of the frame cover 70 and the support-recess 47*b* of the left ribbon frame 43. Accordingly, the head housing 60 is supported such that, as shown by an arrow A, it is possible to rotate the support-recess 61*a* of the right side face 62 and the support-protrusion 63*a* of the left side face 64 within the allowance range of the support-recess 61*b* of the right side face 62 and the support-protrusion 63*b* of the left side face 64 in the loosely fit state. Therefore, the thermal head 12 is pressed to the platen roller 11 by the biasing force of the spring 67 provided between the pressing member 66 abutting to the eccentric member 45 and the thermal head 12 fixed to the head housing 60.

In addition, the ribbon take-up shaft 14, the ribbon supply shaft 15, and the regulating shaft 44 projecting out to the fitting portion 49, are inserted respectively into the through-holes 71, 72 and 73 which are formed on the frame cover 70. Therefore, it is possible to respectively operate the ribbon take-up shaft 14, the ribbon supply shaft 15 and the regulating shaft 44 through the through-holes 71, 72 and 73.

Detaching the head housing 60 attached to the printing unit 40 is performed in a reverse procedure of the attachment of the head housing 60 to the printing unit 40. In other words, by pressing the resin spring portions 76 formed on the side surface of the frame cover 70 through the notches 51, the engagement of the engaging projections 77, formed on the resin spring portions 76, with the engaging recesses 52, formed on the frame rim 48, are released. Then, by pressing the resin spring portions 76 formed on the side surfaces, the frame cover 70 is detached from the fitting portion 49. In this way, it is possible to detach the head housing 60 from between the right ribbon frame 42 and the left ribbon frame 43.

Furthermore, the present embodiment is configured to provide the support-recess 47*a* and support-recess 47*b* on the opposing surface of the left ribbon frame 43, and the support-protrusion 63*a* and the support-protrusion 63*b* on the left side face 64 of the head housing 60. However, the support-protrusions may be provided on the opposing surface of the left ribbon frame 43, and the support-recesses may be provided on the left side face 64 of the head housing 60. In addition, in the present embodiment, the support-recess 47*a* formed on the opposing surface on the left ribbon frame 43 is configured in a round shape of which the diameter is larger than that of the support-protrusion 63*b* formed on the left side face 64 of the head housing 60. Together with this, in the present embodiment, the support-recess 61*b* formed on the right side face 62 of the head housing 60 is configured such that it is in a round shape of with a diameter larger than that of the support-recess 75 formed on the frame cover 70. However, the shape of the support-recess 47*a* and the support-recess 61*b* may be in an elongated shape hole to guide the rotational movement of the head housing 60.

As explained above, according to the present embodiment, the thermal printer 10 comprises a printing unit 40 provided with a left ribbon frame 43 and a right ribbon frame 42 facing each other; a head housing 60 supporting the thermal head 12 and attached between the left ribbon frame 43 and the right ribbon frame 42; a supporting-recess 47*a* provided on an opposing surface on the left ribbon frame 43 facing the right ribbon frame 42 supporting a left side face 64 of the head housing 60; and a frame cover 70 fitted and removed to and from a fitting portion 49 provided on the outer surface of the right ribbon frame 42 which is at the back side of the surface facing the left ribbon frame 43 and supporting a right side face 62 of the head 60 housing through a through-hole 50*a* formed on the right ribbon frame 42. The thermal printer 10 of the present embodiment enables easily attaching and detaching the head housing 60 supporting the thermal head 12 by only fitting and removing the frame cover 70 to and from the outer surface of the right ribbon frame 42. In addition, the thermal printer 10 of the present embodiment achieves an effect of easily attaching the thermal head 12 to the printing unit 40 without requiring a tool such as a screw driver.

Furthermore, according to the present embodiment, the thermal printer 10 is configured such that a support-recess 61*a* for the head housing 60 to be supported is formed on the right side face 62 of the head housing 60, and on the frame cover 70, a support-protrusion 74 fitted into the support-recess 61*a* formed on the right side face 62 of the head housing 60 through the through-hole 50*a* formed on the right ribbon frame 42 is formed. In this way, the thermal printer 10 of the present embodiment achieves an effect of accurately performing positioning of the head housing 60 supporting the thermal head 12 by removably fitting the frame cover 70 to the outer surface of the right ribbon frame 42.

Furthermore, according to the present embodiment, the thermal printer 10 is configured such that the support-recess 47*a* provided on the left side face 64 of the head housing 60 supports the left side face 64 of the head housing 60 at a more upstream side of the conveyance direction of the printing medium 1 than the thermal head 12 as a rotational axis enabling to move rotationally, and the support-recess 61*a* formed on the right side face 62 of the head housing 60 is in a round shape, with the rotational axis of the support-recess 47 is consistent with the axis of the support-recess 61*a*. In this way, the thermal printer 10 of the present embodiment can rotatably support the thermal head 12 by removably fitting the frame cover 70 only to the outer surface of the right ribbon frame 42, thereby achieving an effect of simplifying the mechanism pressing the thermal head 12 to the platen roller 11.

Furthermore, according to the present embodiment, a ribbon take-up shaft 14 and a ribbon supply shaft 15 are rotatably bridged over between the left ribbon frame 43 and the right ribbon frame 42. In this way, the thermal printer 10 of the present embodiment can use the left ribbon frame 43 and the right ribbon frame 42, where the ribbon take-up shaft 14 and the ribbon supply shaft 15 are bridged over, also as a support for the thermal head 12, thereby achieving the effects of cost reduction by reducing the number of parts, and downsizing of the thermal printer 10.

Still furthermore, according to the present embodiment, the thermal printer 10 has a driving force transferring mechanism on the left ribbon frame 43 for transferring the driving force to the ribbon take-up shaft 14, and on the frame cover 70, the through-holes 71 and 72 are formed respectively at the places corresponding to the ribbon take-up shaft 14 and the ribbon supply shaft 15. In this way, the thermal printer 10, even in a state with the frame cover 70 fitted to the outer surface of the right ribbon frame 42, makes it possible to achieve the effect of easily regulating the ribbon take-up shaft 14 and the ribbon supply shaft 15 through the through-holes 71 and 72 formed on the frame cover 70 from the right ribbon frame 42 side where the driving force transferring mechanism is not provided.

Furthermore, the thermal printer 10 of the present embodiment is configured with a head pressure regulating unit regulating the head pressure of the thermal head 12 by the rotational movement of a regulating shaft 44 bridged over in perpendicular direction to the left ribbon frame 43 and the right ribbon frame 42, and on the frame cover 70, a through-hole 73 is formed at a place corresponding to the regulating shaft 44. In this way, the thermal printer 10 of the present embodiment, even in a state with the frame cover 70 fitted to the outer surface of the right ribbon frame 42, makes it possible to achieve the effect of easily regulating the head pressure from the right ribbon frame 42 side by operating the regulating shaft 44 through the through-hole 73 formed on the frame cover 70.

While the present invention has been described in relation to the above embodiment thereof, it is not to be considered as limiting, and that it is apparent that other variations and modifications may be made within the scope of the technological thoughts of the present invention. The numbers, positions, and forms, etc. of the above configuring components are not to be limited to the above embodiment, and may be modified to preferable numbers, positions, and forms, etc. The same reference number is used for the same configuration components in each diagram.

The invention claimed is:

1. A thermal printer which prints by holding and conveying a printing medium between a platen roller and a thermal head, the printer comprising:

a printing unit including a first frame and a second frame laterally spaced away from the first frame in a width direction of the printing medium;

the second frame including a surface facing the first frame and an outwardly facing surface provided on an opposite side of the second frame from the surface facing the first frame;

a head housing including a first side face and a second side face, the head housing configured to support the thermal head and attached between the first frame and the second frame;

a supporting unit provided on a surface of the first frame facing and opposing the second frame, the supporting unit supporting the first side face of the head housing;

a fitting portion positioned on the outwardly facing surface of the second frame; and a frame cover fitted on and removable from the fitting portion provided on the outwardly facing surface of the second frame, and the frame cover supporting the second side face of the head housing through a through-hole formed on the second frame, wherein the frame cover is positioned and configured to be positioned in and removed from the outwardly facing surface of the second frame so as to attach and to detach the head housing.

2. The thermal printer according to claim 1 further comprising:

a support-recess for the head housing, the support-recess formed on the second side face of the head housing; and a supporting-protrusion on the frame cover and fitted into the support-recess formed on the second side face of the head housing through a through-hole on the second frame;

wherein the supporting-protrusion and the support-recess are positioned and configured so as to facilitate attaching and removing of the thermal head to and from the printing unit without use of any tools.

3. The thermal printer according to claim 2, wherein the supporting unit supports the first side face of the head housing at a more upstream side of the conveyance direction of the printing medium than the thermal head and supporting the head housing at a rotational axis enabling the head housing to rotate, and wherein the support-recess formed on the second side face of the head housing has a round shape, with the rotational axis supported by the supporting unit consistent with the axis of the support-recess.

4. The thermal printer according to claim 1, wherein the thermal printer performs printing by transferring ink from an ink ribbon onto the printing medium;

further comprising a ribbon supply shaft positioned and configured to supply the ribbon; and a ribbon take-up shaft positioned and configured to take-up the ribbon, wherein the ribbon supply shaft and the ribbon take-up shaft extend between the first frame and the second frame and are rotatably bridged over between the first and second frame.

5. The thermal printer according to claim 4 further comprising:

a driving force transferring mechanism positioned and configured to transfer a driving force to the ribbon take-up shaft at the first frame; and through-holes formed in the frame cover, respectively, at the places corresponding to the ribbon take-up shaft and the ribbon supply shaft.

6. The thermal printer according to claim 1, further comprising:

a rotatable head pressure regulating unit configured for regulating the head pressure of the thermal head by rotation of a regulating shaft bridged over perpendicular to the first frame and the second frame, wherein a through-hole is formed in the frame cover at a place corresponding to the regulating shaft.

7. A thermal printer configured to print by holding and conveying a printing medium between a platen roller and a thermal head, the printer comprising:

a printing unit including a first frame and a second frame laterally spaced away from the first frame in a width direction of the printing medium;

the second frame including a surface facing the first frame and an outwardly facing surface provided on an opposite side of the second frame from the surface facing the first frame;

a head housing including a first side face and a second side face, the head housing configured to support the thermal head and attached between the first frame and the second frame;

a supporting unit provided on a surface of the first frame facing and opposing the second frame, the supporting unit positioned and configured to support the first side face of the head housing;

a fitting portion positioned on the outwardly facing surface of the second frame; and a frame cover fitted on and removable from the fitting portion provided on the outwardly facing surface of the second frame, the frame cover positioned and configured to support the second side face of the head housing through a through-hole formed on the second frame, wherein the supporting unit supports the first side face of the head housing at a more upstream side of the conveyance direction of the printing medium than the thermal head and supporting the head housing at a rotational axis enabling the head housing to rotate, and wherein the support-recess formed on the second side face of the head housing has a round shape, with the rotational axis supported by the supporting unit consistent with the axis of the support-recess.

8. A thermal printer configured to print by holding and conveying a printing medium between a platen roller and a thermal head, the printer comprising:

a printing unit including a first frame and a second frame laterally spaced away from the first frame in a width direction of the printing medium;

the second frame including a surface facing the first frame and an outwardly facing surface provided on an opposite side of the second frame from the surface facing the first frame;

a head housing including a first side face and a second side face, the head housing configured to support the thermal head and attached between the first frame and the second frame;

a supporting unit provided on a surface of the first frame facing and opposing the second frame, the supporting unit positioned and configured to support the first side face of the head housing;

a fitting portion positioned on the outwardly facing surface of the second frame; and a frame cover fitted on and removable from the fitting portion provided on the outwardly facing surface of the second frame, the frame cover positioned and configured to support the second side face of the head housing through a through-hole formed on the second frame, a rotatable head pressure regulating unit configured to regulate the head pressure of the thermal head by rotation of a regulating shaft bridged over perpendicular to the first frame and the second frame, wherein a through-hole is formed in the frame cover at a place corresponding to the regulating shaft.

* * * * *